US006022019A

United States Patent [19]

Zimmermann

[11] Patent Number: 6,022,019

[45] Date of Patent: Feb. 8, 2000

[54] DEVICE FOR CHECKING SHEET ARTICLES SUCH AS BANK NOTES

[75] Inventor: Karl-Heinz Zimmermann, Gauting, Germany

[73] Assignee: Giesecke & Devrient GmbH, Munich, Germany

[21] Appl. No.: 08/945,672

[22] PCT Filed: May 9, 1996

[86] PCT No.: PCT/EP96/01965

§ 371 Date: Jan. 29, 1998

§ 102(e) Date: Jan. 29, 1998

[87] PCT Pub. No.: WO96/36020

PCT Pub. Date: Nov. 14, 1996

[30] Foreign Application Priority Data

May 11, 1995 [DE] Germany ..... 195 17 294

[51] Int. Cl.[7] ..... B65H 7/02

[52] U.S. Cl. ..... 271/258.01; 271/258.04; 271/258.05; 271/259

[58] Field of Search ..... 271/258.01, 258.04, 271/258.05, 259

[56] References Cited

U.S. PATENT DOCUMENTS 4,862,064 8/1989 Sumi ..... 271/258.01
5,165,044 11/1992 Eschweiler, Jr. et al. ..... 235/475

*Primary Examiner*—Donald P. Walsh
*Assistant Examiner*—Daniel Keith Schlak
*Attorney, Agent, or Firm*—Bacon & Thomas, PLLC

[57] ABSTRACT

An apparatus for testing sheet material with sensors having one or more components and fastened to the front of a base plate as separate units on one and/or both sides of a sheet material path. The fastening system includes a first fastening device which is operable from the back of the base plate and permits removal of the sensor in the released state. In order to open a gap between at least one component of a sensor and the transport path, this component has second fastening device which is operable from the front of the base plate and permits only motion of the component relative to the transport system in the released state. Removal of the sensor is impossible in the released state of the second fastening means unless the first fastener device is released.

15 Claims, 5 Drawing Sheets

DEVICE FOR CHECKING SHEET ARTICLES SUCH AS BANK NOTES

BACKGROUND OF THE INVENTION

1. Field of the Invention

This invention relates to an apparatus for testing sheet material such as bank notes.

2. Related Art

Such an apparatus is known from DE-PS 32 42 789. The device uses a plurality of sensors each consisting of two components. The two components are disposed on opposite sides of a transport path which transports the sheet material through the sensors. The components of the sensors on one side of the transport path are combined into a group and fastened to a separate mounting plate.

In order to permit access to the transport path in the area of the sensors, e.g. for eliminating sheet material jams or maintenance of the sensor surfaces facing the transport path, the mounting plate is pivoted and can be rotated out of the base plate plane. This rotation opens the sensor gap formed by the component of a sensor and the transport path and exposes the front side of the sensor components facing the transport path and the transport path itself. This permits elimination of a bank note jam or cleaning of the front sides of the sensor components in a simple way.

In order to prevent removal of security-relevant components of sensors by unauthorized persons, these components are protected with an alarm loop. This can be realized in the simplest case in the form of an unbridgeable electric circuit. Since the electric supply lines to the sensors need not be interrupted in the apparatus, the gap formed by the sensors can be opened without triggering an alarm.

Time-consuming adjustment of the sensors after removal of a bank note jam or maintenance of the front sides of the sensor components is unnecessary since the original adjustment is restored when the mounting plate is turned back.

A disadvantage of the apparatus is that the sensors must be disposed on an axis and parallel to each other for effective use of a mounting plate. If there is a large number of sensors this results in an elongate apparatus with a large space requirement. Further, the housings of the individual sensor components should be of like construction if possible. If the housings have different sizes the mounting plate must be adapted to the largest housing, which again involves a relatively large space requirement. In order to protect the sensor components from removal by unauthorized persons one must provide each with an alarm loop.

On these premises, the invention is based on the problem of proposing an apparatus for testing sheet material wherein the sensor gap formed by the sensor components and the transport path can be opened and which simultaneously ensures a spacesaving arrangement of the sensors and protection of the sensor components from removal by unauthorized persons.

BRIEF SUMMARY OF THE INVENTION

The basic idea of the invention is substantially to fasten the sensors consisting of assemblies of one or more components to the front of the base plate as separate units on one and/or both sides of the transport path. The means used for fastening are first fastening means or assembly operable from the back of the base plate and permitting removal of the sensor in the released state. To permit opening of the sensor gap between a certain sensor component and the transport path, these sensor components have second fastening means or assembly operable from the front of the base plate and permitting only motion of the sensor component relative to the transport system in the released state. Removal of the sensor is impossible in the released state of the second fastening means.

An advantage of the apparatus is that since the sensors are fastened to the base plate as separate units there is no prior restriction either on the position of the sensors relative to each other or on the construction of the sensor housing. The sensors can therefore be disposed on the base plate in the most space-saving way.

Since the first fastening means of the sensors are operable only from the back of the base plate, it is possible to remove a sensor component only if the person has access to the back of the base plate. It is unnecessary to protect the sensor components from removal individually. It suffices merely to protect the back of the base plate from unauthorized access.

By releasing the second fastening means of certain sensor components one can move the latter relative to the transport system and thus open the sensor gap between the sensor component and the transport system.

In a preferred embodiment the immobile components of the sensors are fixed for example by means of screws which can only be loosened from the back of the base plate.

The movable sensor components have as first fastening means a closing lever rotatable about an axis. For fastening the movable sensor component, the closing lever is inserted through a suitable elongate opening gap in the base plate and rotated about the axis so as to be substantially perpendicular to the opening in one direction. A spring system presses the closing lever in the direction of the base plate so that the movable sensor component is held reliably.

The second fastening means of the movable sensor component consist substantially of a rocker which can be fixed or released by means of a latch closure. The rocker is disposed between the closing lever of the first fastening means and the back of the base plate.

When the rocker is released by means of the latch closure accessible from the front of the base plate, a space arises between the rocker and closing lever and the sensor can be moved in the direction of the space on the base plate. The electric connections of the movable sensor component can be disposed so as to be maintained during motion of the movable sensor component.

DESCRIPTION OF THE DRAWINGS

In the following the preferred embodiment of the invention will be described with reference to the figures, in which.

DETAILED DESCRIPTION OF THE PREFERRED EMBODIMENT OF THE INVENTION

Figure 1:
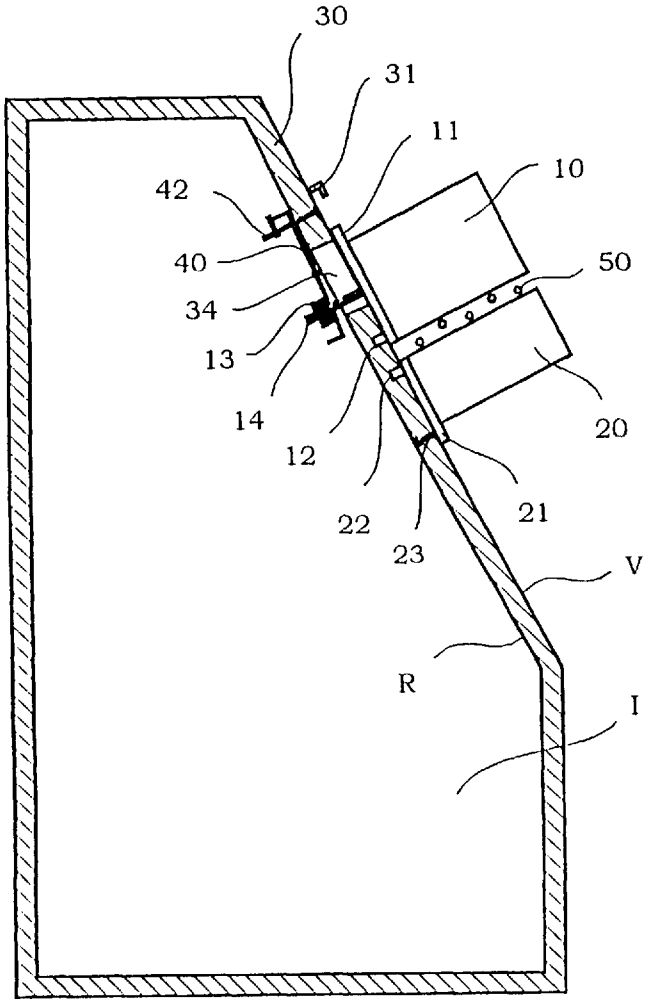
FIG. 1 shows a schematic diagram of an inventive apparatus.

FIG. 1 shows a schematic diagram of an inventive apparatus. It shows a sensor assembly consisting of movable sensor component 10 and fixed sensor component 20. Opposed sensor components 10, 20 are disposed on opposite sides of sheet material transport system 50 serving to transport the sheet material along a transport path to be tested. The sensor is fastened to front V of base plate 30. Base plate 30 is part of closed housing 35 and disposed such that back R of base plate 30 points into interior I of closed housing 35.

Fixed sensor component 20 has back wall 21 with adjusting pin 22. The latter is introduced in a corresponding recess in base plate 30 so as to ensure correct adjustment of fixed sensor component 20. The first fastening means used for fixed sensor component 20 can be for example screw 23 which is screwed into back wall 21 of the sensor through base plate 30 from the back. This measure ensures that only those persons are able to remove fixed sensor component 20 from base plate 30 who have access to back R of base plate 30 or to interior I of housing 35.

Movable sensor component 10 also has back wall 11 with adjusting pin 12. Adjusting pin 12 is introduced in a suitable recess in base plate 30 so as to ensure correct adjustment of movable sensor component 10. The gap between movable sensor component 10 and transport system 50 is designated a sensor gap and is a "closed gap" in this position.

Movable sensor component 10 has axle 14 connected with back wall 11. Axle 14 passes through an elongate opening 34 in base plate 30 and protrudes beyond back R of base plate 30. Pivoted to the free end of axle 14 is closing lever 13.

For fastening movable sensor component 10 one brings closing lever 13 into a locked position extending substantially perpendicular to opening 34. Closing lever 13 is pressed by means of a spring system in the direction of base plate 30 so that movable sensor component 10 is seated firmly on base plate 30 when closing lever 13 is closed.

For removing movable sensor component 10 one rotates closing lever 13 from back R of base plate 30 into an open position substantially parallel to opening 34. The form of closing lever 13 is selected so that the latter can be guided through opening 34 in the open position and movable sensor component 10 thus removed. Removal of movable sensor component 10 from base plate 30 is therefore only possible if access to back R of base plate 30 is ensured.

For moving movable sensor component 10 second fastening means are provided which consist of rocker 40 and a latch closure 42. Closure 42 can be operated from front V of base plate 30 and fixes rocker 40 in the closed state. In the open state rocker 40 is movable.

Rocker 40 is disposed between closing lever 13 of the first fastening means and back R of base plate 30 so as to form the support for closing lever 13. When closure 42 is closed and rocker 40 therefore locked, the latter presses against closing lever 13 so that movable sensor component 10 is fixed in its position. When closure 42 is open, rocker 40 is movable and the pressure against closing lever 13 vanishes. Movable sensor component 10 is now loosened and can be moved up and down along opening 34. Removal of movable sensor component 10 is impossible since in its closed position closing lever 13 cannot be guided through opening 34.

Figure 2:
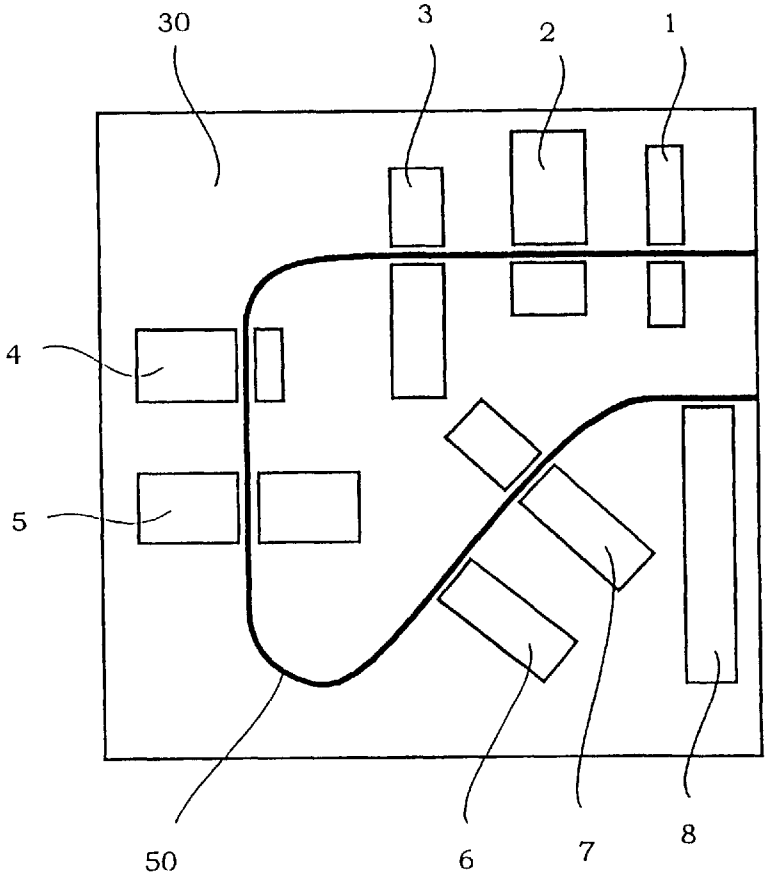
FIG. 2 shows a schematic diagram of a sensor arrangement on a base plate.

FIG. 2 shows base plate 30 with an exemplary arrangement of sensors 1 to 8 on transport path 50. By suitable layout of transport path 50 and suitable arrangement of sensors 1 to 8 on transport path 50 one can minimize the space requirement of the apparatus. The design of the housings of the sensors is subject to virtually no restrictions. The sensors can have components which are mounted either only on one or on both sides of transport path 50. Which sensor components are movable and which are fixed depends on the boundary conditions of the sensor. These boundary conditions can be for example ease of maintenance, susceptibility to repair, frequency of sheet jams, etc.

Figure 3:
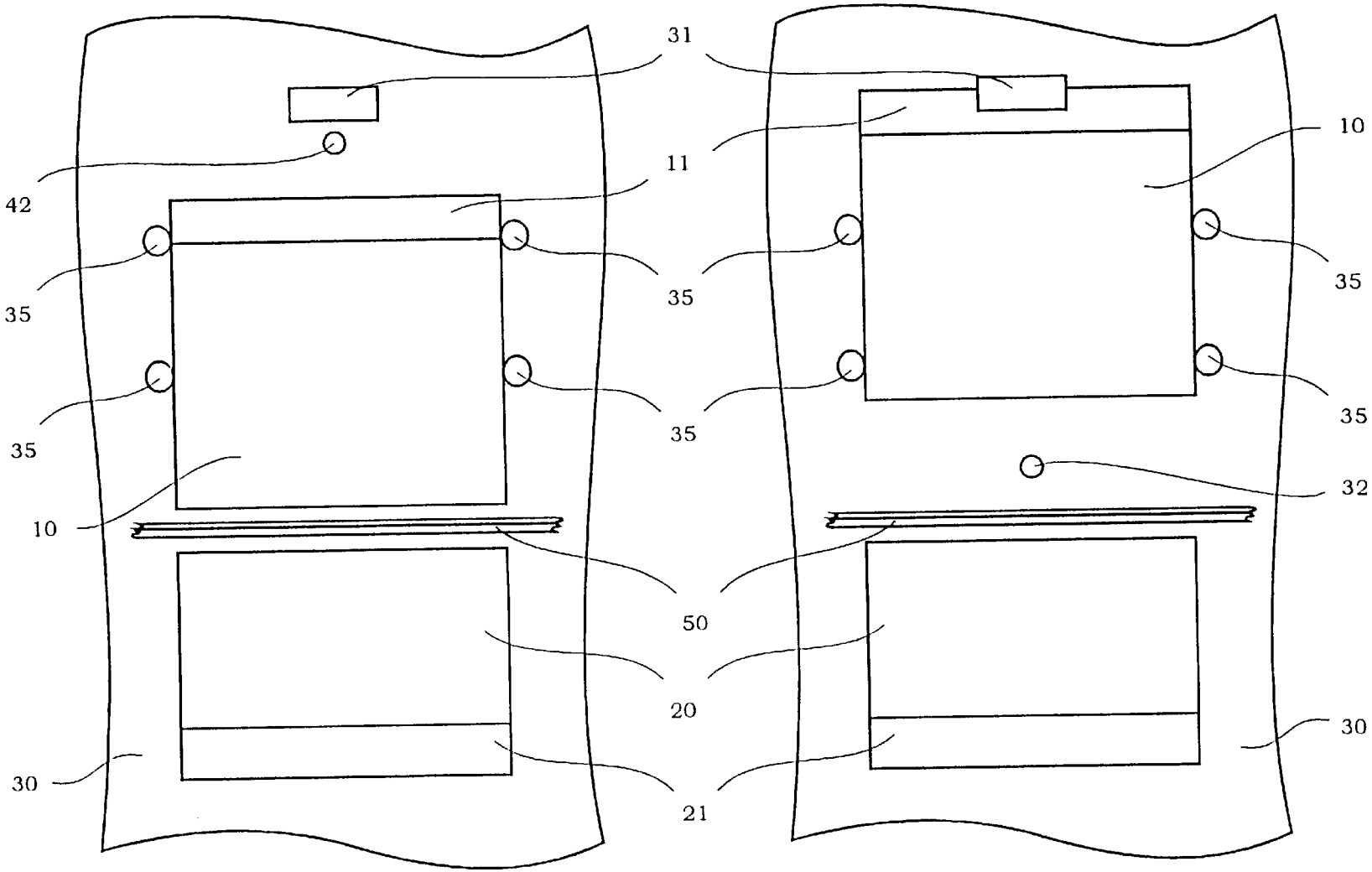
FIG. 3 shows a front view of a sensor with a closed sensor gap and an open sensor gap.

FIG. 3 shows a schematic diagram of the front view of a sensor. With a closed sensor gap, closure 42 accessible from the front of base plate 30 is closed. When closure 42 is opened or released, movable sensor component 10 can be shifted upward along opening 43 (not visible here) until base plate 11 hits stop 31. The sensor gap between transport system 50 and movable sensor component 10 is designated "open gap" in this position. In order to prevent rotation of movable sensor component 10, lateral guides 35 are provided. With an open sensor gap one can see recess 32 in base plate 30 which adjusting pin 12 penetrates with a closed sensor gap.

Figure 4:
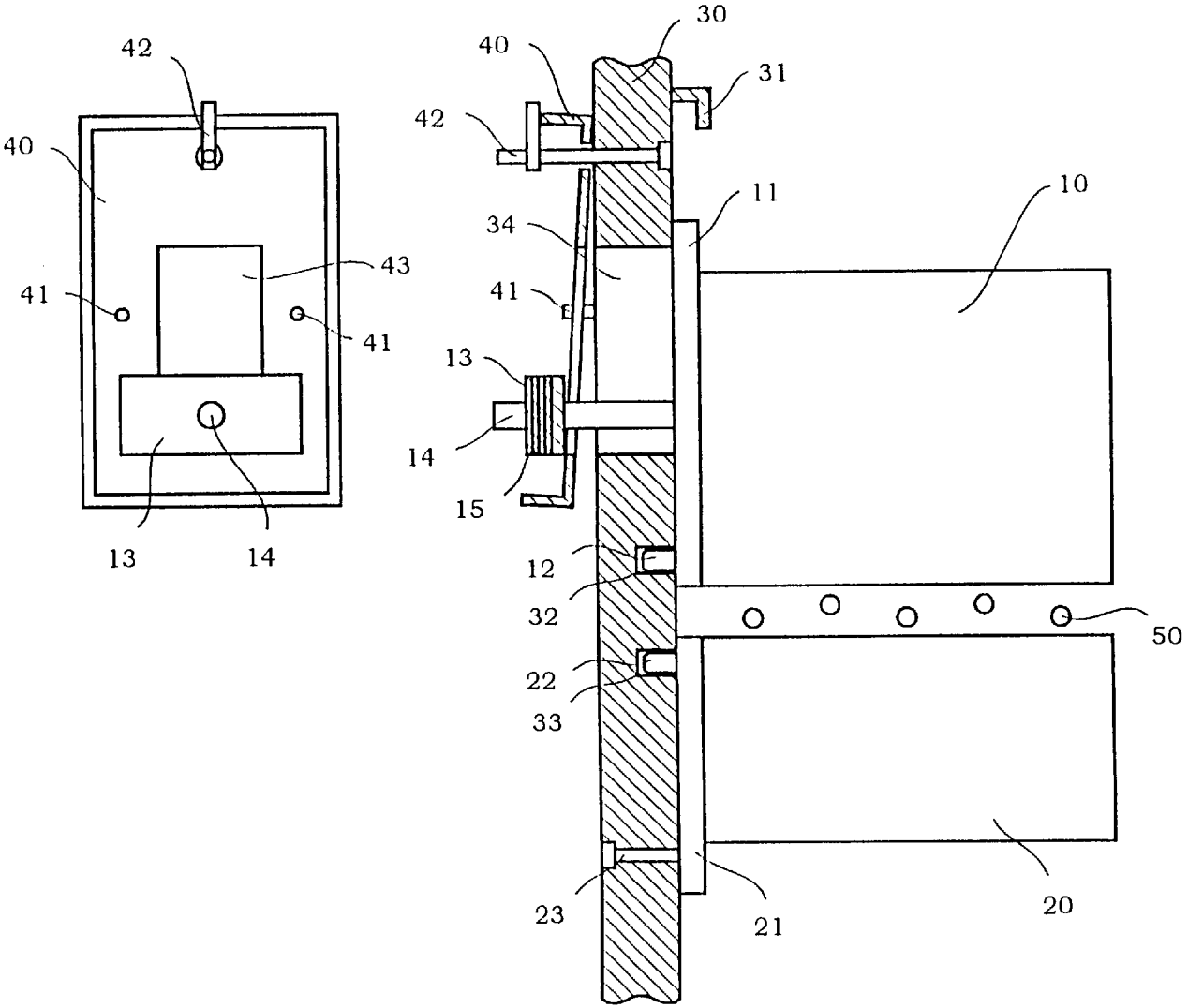
FIG. 4 shows a side view of the sensor with a rear view of the fastening means with a closed sensor gap.

FIG. 4 shows an enlarged side view of the apparatus and a rear view of the fastening means. In the embodiment selected here, rocker 40 consists of a rectangular plate mounted on two rocker bearings 41. Closure 42 is guided through rocker 40. In rocker 40 there is an opening gap 43 whose dimensions substantially match opening gap 34 in base plate 30.

FIG. 4 shows how adjusting pins 12, 22 engage recess 32, 33 provided therefor in base plate 30. Closing lever 13 is in the locked position and rocker 40 is fixed by means of closure 42. The pressure of closing lever 13 on rocker 40 serving as a support is realized here by leaf spring system 15.

Figure 5:
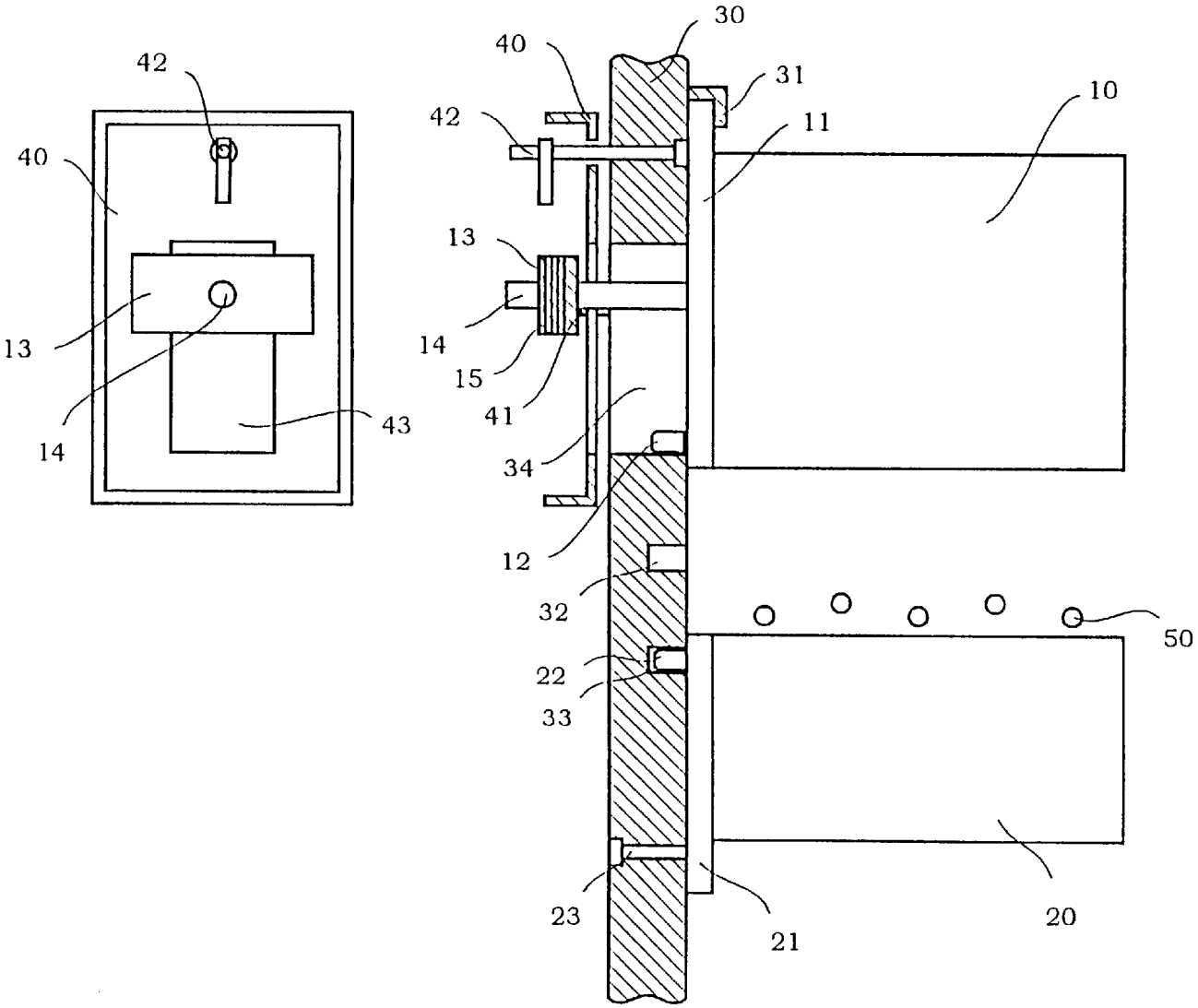
FIG. 5 shows a side view of the sensor with a rear view of the fastening means with an open sensor gap.

FIG. 5 shows a corresponding detail with an open sensor gap. Closure 42 is open, and rocker 40 can be moved. Spring system 15 is now no longer able to press closing lever 13 against rocker 40. This frees movable sensor component 10 so that adjusting pin 12 can be drawn out of groove 32 and movable sensor component 10 moved in the direction of the sensor gap. The dimensions of sensor gap 34 in adjusting pin 12 and of stop 31 are preferably selected so that movable sensor component 10 is held reliably by adjusting pin 12 and stop 31 with an open sensor gap.

Removal of movable sensor component 10 is impossible since closing lever 13 is still in the closed position. Rotation of movable sensor component 10 can be prevented by suitable choice of the dimensions of base plate 11, stop 31, opening gap 34, etc. Guides 35 (not visible here) additionally counteract rotation of movable sensor components 10.

Figure 6:
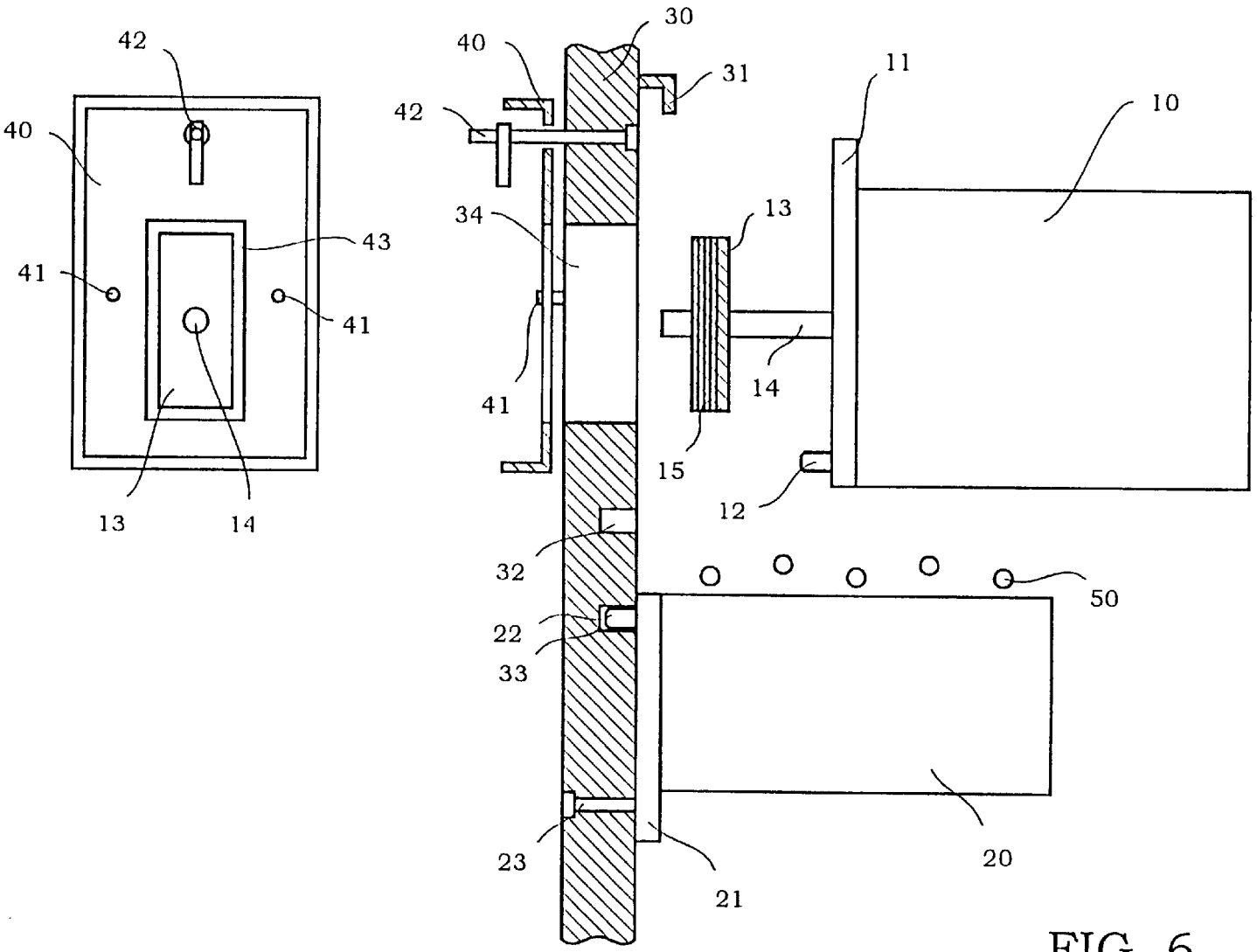
FIG. 6 shows a side view of the sensor with a rear view of the fastening means with the sensor component removed.

FIG. 6 shows the removal of movable sensor component 10. Closing lever 13 is rotated into the open position and can now be moved through opening gap 43 and opening gap 34 so that movable sensor component 10 can be removed from base plate 30.

As explained above, each sensor component has first fastening means which are only operable from the back of base plate 30 and permit removal of the sensor in the released state. Since base plate 30 is located in housing 35 and disposed there so that its back points into the interior of housing 35, one need merely protect the interior of housing 35 against unauthorized access.

It suffices to protect the ways of access to interior I of housing 35, for example by means of an alarm loop. In order to permit access to authorized persons, the opening and, if required, the closing of housing 35 can be allowed by suitable authorization of the person for the apparatus. This authorization can be made possible for example by entry of a suitable code on the input device of the apparatus or by insertion of a chip card into the apparatus. Access by means of mechanical keys is of course also possible. To increase security, the opening or closing of housing 35 can be stored in the apparatus and logged if required.

Security-critical sensor components can be additionally protected by mechanical means such as lead seals or electric means such as alarm loops, so that the removal of such a sensor component by an authorized person is also registered.

I claim:

1. Apparatus for testing sheet material transported along a sheet material transport path comprising:

a base plate having front and rear sides;

at least one sheet material sensor component disposed along a sheet material transport path mounted on the front side of the base plate, said at least one sensor component spaced from the transport path by a sensor gap, said sensor component being mounted on the base plate by a fastener system enabling relative movement of the sensor component relative to the base plate to enlarge and reduce said sensor gap, and removably mounting the sensor component on the base plate;

said fastener system comprising:

a first fastener assembly accessible from the back side only of the base plate and connected to and securing the sensor component against removal from the base plate unless released;

a second fastener assembly accessible from the front side of the base plate connected to and adjustably securing the sensor components on the base plate for enabling relative movement of the sensor component relative to the base plate in directions enabling expansion and reduction of the sensor gap when released but not removal of the sensor component from the base plate.

2. The apparatus as claimed in claim 1, wherein said sheet material sensor component comprises a first component of a sensor assembly including an opposed second sensor component located adjacent and opposite the first component, said first and second components located on opposite sides of said sheet material transport path, and spaced apart by a distance including said sensor gap, said second component fixedly mounted on said base plate; and a fastener accessible only from the rear side of the base plate removably securing said second component to said base plate.

3. The apparatus as claimed in claim 1, including guides mounted on the front side of said base plate, said guides restricting relative movement between the sensor component and the base plate to movement perpendicular to said sheet material transport path.

4. The apparatus as claimed in claim 1, wherein said first fastener assembly includes a biasing spring arranged to resiliently urge the sensor component against the front side of said base plate when the first fastener assembly is in a locked position securing the sensor component against removal from the base plate.

5. The apparatus as claimed in claim 4, said first fastener assembly including a closing lever pivoted for rotation about a pivot axle connected to said sensor component and extending through an opening in said base plate; said second fastener assembly including a tiltable rocker between said lever and rear side of said base plate; said spring biasing said lever and said axle in a direction urging the sensor component towards said base plate front side when said rocker is moved into a first position; said second fastener assembly including a latch operable between secured and released positions upon actuation of the second fastener assembly, said latch in the secured position engaging and moving the rocker to said first position; said latch in the released position enabling movement of the rocker to a second position releasing the bias of said spring from said lever and axle.

6. The apparatus as claimed in claim 1, said apparatus including a closed housing defining an interior closed space, the rear side of said base plate facing into and accessible only from said interior space.

7. The apparatus as claimed in claim 6, including a security protection arrangement restricting unauthorized access to the housing material.

8. The apparatus as claimed in claim 7, said security protection arrangement including means for enabling access to said interior only upon activation by a code or chip card.

9. The apparatus as claimed in claim 8, including means for storing and/or logging said access.

10. The apparatus as claimed in claim 8, including means for registering the unauthorized removal of a sensor component from said base plate.

11. The apparatus as claimed in claim 10, wherein said first fastener assembly comprises a rotatable closing lever comprising a lever element having a length and width, the length of the lever element being greater than the width; an opening in said base plate covered by the sensor component in its mounted position on the base plate; said opening having an opening length and an opening width, with the opening length being greater than the opening width, said opening width being less than the length of said lever and at least slightly larger than the lever width, and said opening length being at least slightly larger than the length of said lever; a pivot axle connecting said lever element to said sensor component, said axle extending through said opening in said base plate; said lever element pivotally mounted on a portion of said axle located towards the rear side of said base plate; said lever element located with its length traversing the width of said base plate opening when the first fastener assembly is in a secured position, and with its length extending parallel to the length of said opening when the first fastener assembly is in a released position.

12. The apparatus as claimed in claim 11, including a spring biasing device located between the rear side of the base panel and the lever element, said spring resiliently urging the lever element, axle and sensor component in a direction to cause the sensor component to be biased towards the front side of the base panel when the first and second fastener assembly are in secured positions.

13. The apparatus as claimed in claim 12, including a recess in the front side of the base plate; an adjusting pin mounted to a wall of said sensor component facing towards said front side; said pin located in said recess when the sensor component is secured against removal on the base plate by the fastener system; guide elements on the front side of said base plate limiting motion of said sensor component relative to said base plate upon release of said second fastener assembly in directions perpendicular to the sheet material transport path, and upon disengagement of said pin from said recess; said spring biasing device accommodating the release of the pin from the recess upon release of the second fastener assembly.

14. The apparatus as claimed in claim 13, including a tiltable rocker pivotally mounted on the rear side of the base plate between said lever element and said rear side; said axle projecting through said rocker; said second fastener assembly including a movable latch engaging the rocker and arranged to enable movement of the rocker between first and second positions upon movement thereof; movement of the rocker to its first position causing the rocker to urge the lever element, axle and sensor component in a direction to cause the sensor component to be pressed against the front side of the base panel; movement of said rocker to its second position enabling motion of the lever element, axle and sensor component so that the sensor component may be displaced away from the front side of the base plate a distance at least sufficient to enable withdrawal of the pin from the recess and sufficient to permit movement of the sensor component relative to the base plate.

15. The apparatus as claimed in claim 11, including a recess in the front side of the base plate; an adjusting pin mounted to a wall of said sensor component facing towards said front side; said pin located in said recess when the sensor component is secured against removal on the base plate by the fastener system.

* * * * *